US005123323A

United States Patent [19]

Fujita et al.

[11] Patent Number: 5,123,323

[45] Date of Patent: Jun. 23, 1992

[54] APPARATUS AND METHOD FOR DESIGNATING AN EXTREME-VALUE CHANNEL IN AN ELECTRONIC MUSICAL INSTRUMENT

[75] Inventors: Yoshio Fujita; Tomomi Miyata; Masashi Hirano, all of Hamamatsu, Japan

[73] Assignee: Yamaha Corporation, Hamamatsu, Japan

[21] Appl. No.: 595,030

[22] Filed: Oct. 10, 1990

[30] Foreign Application Priority Data

Oct. 11, 1989 [JP] Japan ..... 1-264456

[51] Int. Cl.[5] ..... G10H 5/00; G10H 1/02; G10H 7/00; G10H 1/46

[52] U.S. Cl. ..... 84/663; 84/627; 84/633; 84/665

[58] Field of Search ..... 84/618, 627, 633, 656, 84/663, 665, 684, 702, 711, 615, DIG. 2, 617, 653, 655, 678, 682

[56] References Cited

U.S. PATENT DOCUMENTS 4,114,495 9/1978 Tomisawa ..... 84/1.01
4,365,532 12/1982 Nakada et al. ..... 84/DIG. 22 X
4,703,680 11/1987 Wachi et al. ..... 84/1.26
4,788,896 12/1988 Uchiyama et al. ..... 84/624
4,922,796 5/1990 Kondo et al. ..... 84/618
4,969,385 11/1990 Williams et al. ..... 84/656

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

A detector unit is provided which receives envelope signals related to a predetermined number N of channels to detect a channel showing a greatest or smallest level of the envelope signal among the N channels and outputs data indicative of the detected channel and the level of its envelope signal. When the total number M of the channels is larger than N, a plurality of the detector units are provided, the envelope signals of the number M of the channels are divided into groups numbering not more than N, and the groups are distributed to the respective detector units so that the channel of which level of the envelope signal is the greatest or smallest is detected in each of the detector units. The levels of the envelope signals of the channels detected by the respective detector units are compared with each other, and one detector unit connected with the channel of the greatest or smallest level of the envelope signal is identified. Thus, the channel detected by the identified one detector unit is designated as an extreme-value channel. The designated extreme-value channel is for example a truncating channel to be used for tone generation assignment process.

6 Claims, 3 Drawing Sheets

APPARATUS AND METHOD FOR DESIGNATING AN EXTREME-VALUE CHANNEL IN AN ELECTRONIC MUSICAL INSTRUMENT

BACKGROUND OF THE INVENTION

This invention relates to a method of designating an extreme-value channel of which level of an envelope signal is the greatest or smallest, in an electronic musical instrument having a plurality of tone generating channels. The invention is suitably used for example in the truncating process of the musical instrument.

In assigning tone generation of a newly depressed key to any of plural tone generating channels when all the channels have already been assigned or occupied, it has been conventional to detect, as a truncating channel, a channel where attenuation of the tone signal has progressed to the farthest degree of all the channels and then to assign the tone generation of the newly depressed key to this truncating channel. Prior art related to such truncating process is shown such as in U.S. Pat. No. 4,114,495 (corresponding to Japanese Patent Application Laid-open No. Sho-52-25613) and U.S. Pat. No. 4,703,680 (corresponding to Japanese Patent Publication No. Hei-1-28397 and Japanese Patent Application Laid-open No. Sho-61-270799).

However, none of the prior art truncating devices have been satisfactory in that the number of the channels to which the truncating process is applied (the truncating-process object channels) is fixed by hardware and can not be expanded as required.

SUMMARY OF THE INVENTION

It is therefore an object of the invention to provide a method of designating an extreme-value channel in an electronic musical instrument, which enables expansion of the number of truncating-process object channels to be easily made as required.

According to the present invention, a method of designating an extreme-value channel in an electronic musical instrument which has a tone forming section capable of forming tone signals in plural number M of channels, and an envelope generating section for generating for each of the channels an envelope signal to control the tone signal is provided, the method designating as the extreme-value channel a channel showing a greatest or smallest level of the envelope signal among said channels, the method comprising steps of: providing a detector unit that receives the envelope signals related to a predetermined number N of the channels to detect a channel showing a greatest or smallest level of the envelope signal among the N channels, and outputs data indicative of a detected channel and of the level of the envelope signal of the detected channel; providing a plurality of the detector units when $M>N$, dividing the envelope signals of the M channels into groups numbering not more than N and distributing the groups to the detector units so that the channel of which level of the envelope signal is greatest or smallest is detected in each of the detector units; and making a comparison between the levels of the envelope signals of the channels detected by the respective detector units, so as to identify one the detector unit connected with the channel showing a greatest or smallest level of the envelope signal among the channels detected by the detector units, whereby the channel detected by identified one detector unit is designated as the extreme-value channel.

One detector unit receives envelope signals related to the predetermined number N of the channels to detect a channel of which level of the envelope signal is the greatest or smallest and then outputs data indicative of the detected channel and the level of the envelope signal thereof. One or more of such detector units are provided as required. For example, if the predetermined number N of the channels processable by one detector unit is 4, and the number M of the truncating-process object channels is 8, two detector units are provided. Similarly, if the number M of the truncating-process object channels is 16, four detector units are provided.

The levels of the envelope signals of the channels detected by the respective detector units are compared with each other so that one detector unit connected with the channel of the greatest or smallest level of the envelope signal level is identified. Thus, the channel detected by the identified one detector unit is designated as the extreme-value channel (i.e., the truncating channel in the case of the truncating process).

In this way, according to the present invention, there will be achieved superior advantageous results that it is possible to deal with the expansion of the channel number by providing a specific number of the detector units as required in correspondence to the number M of the channels in the tone forming section.

An electronic musical instrument in accordance with the present invention comprises: tone forming means capable of forming tone signals in plural number M of channels; envelope generating means for generating for each of said channels an envelope signal to control said tone signal; a plurality of extreme-value channel detector units, each of said detector units having detecting means that receives the envelope signals related to a predetermined number N of the channels to detect a channel showing a greatest or smallest level of the envelope signal among said N channels and outputs data indicative of a detected channel and of the envelope signal level of the detected channel, M being larger than N, and controlling means for making a comparison between the data of the envelope signal levels outputted by said detecting means so as to select as said extreme-value channel a channel further showing the largest or smallest level; and excluding means for excluding from all the channels one or more channels conforming to a predetermined condition so that the extreme-value channel detecting units are caused to detect the extreme-value channel from among the remaining channels.

With this arrangement, the detection of the extreme-value channel is not effected for all the channels but is effected for the remaining channels exclusive of the predetermined channels conforming to the exclusion condition. Hence, the truncating processing etc. can be properly performed depending on various control purposes.

An embodiment of the invention will now be described with reference to the accompanying drawings.

BRIEF DESCRIPTION OF THE DRAWINGS

In the accompanying drawings.

DETAILED DESCRIPTION OF THE PREFERRED EMBODIMENTS

Figure 1:
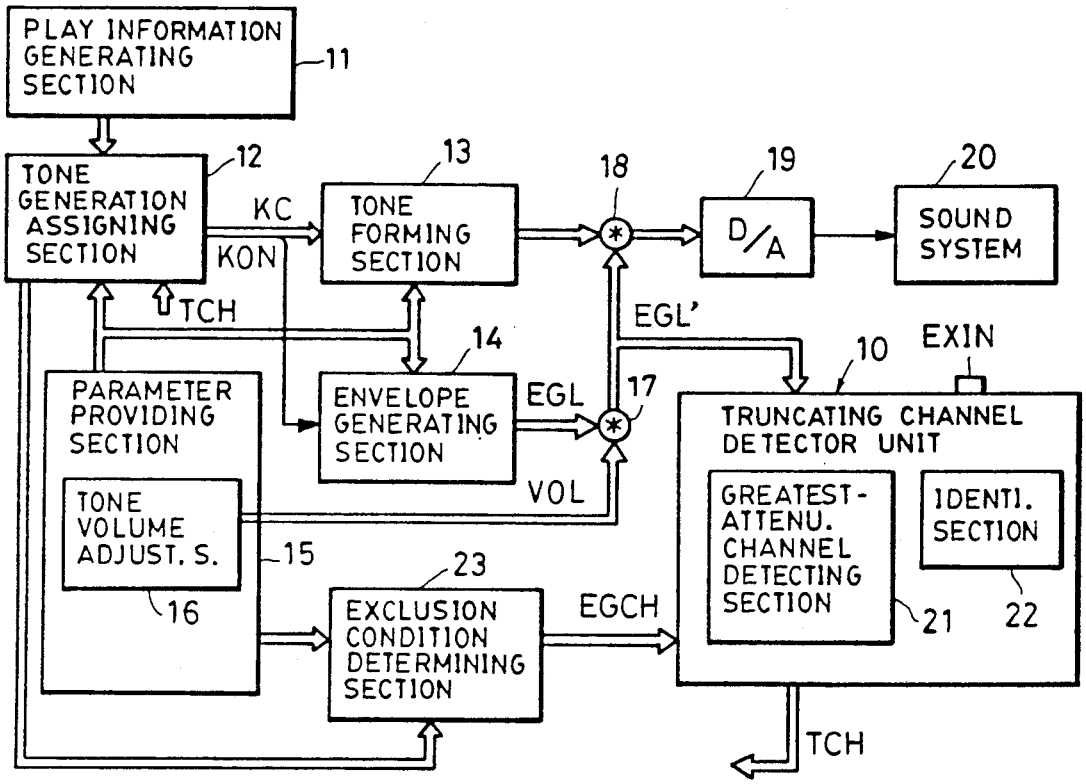
FIG. 1 is a block diagram showing an example systematic arrangement of an electronic musical instrument embodying the present invention.

FIG. 1 shows an example systematic arrangement of an electronic musical instrument embodying the present invention, in which only one truncating channel detector unit 10 is provided.

Play information generating section 11 generates play or performance information that designates a tone to be generated, and it may include, for example, a section such as a keyboard for generating play information (depressed key information) in accordance with the player's real time playing manipulation, or a section such as an automatic bass code playing circuit or a rythmn pattern generating circuit for generating automatic play information.

A tone generation assigning section 12 assigns play information given from the play information generating section 11 to individual channels in a tone forming section 13. A key code KC (information that specifies a key depressed by the player or information that specifies a tone to be automatically generated) and a key-on signal KON (a signal that is responsive to the depression/-release of the key corresponding to the key code KC, or a signal that instructs the start of a tone generation) are outputted from the tone assigning section 12 and fed to the tone forming section 13. The key-on signal KON is also fed to an envelope generating section 14.

The tone forming section 13 includes a plurality of tone generating channels arranged for parallel or time-divisional processing and generates, on the basis of the abovementioned key code KC and key-on signal KON, a tone signal that corresponds to play information assigned to any of the channels. The envelope generating section 14 generates, on the basis of the abovementioned key-on signal KON, an envelope signal for controlling a tone signal produced in each of the channels. In the illustrated example, it is assumed that in the envelope generating section 14, there is generated an envelope signal which controls the tone volume envelope of a tone.

A parameter providing section 15 serves to generate a variety of parameter information related to various tone elements including tone color, tone pitch, tone volume etc., and provides the parameter information to the tone generation assigning section 12, tone forming section 13 and envelope generating section 14. Among the parameter information provided to the tone generation assigning section 12 are, for example, parameter information indicating the relationship between each channel and a tone color assigned thereto in a case where a desired tone color can optionally be assigned to each channel, and parameter information which designates the number of simultaneously soundable tones in a case where such number of the simultaneously soundable tones is varied for producing multi-channel tones. Among the parameter information provided to the tone forming section 13 are, for example, various kinds of parameter information for realizing a selected tone color. Among the parameter information provided to the envelope generating section 14 are, for example, various kinds of parameter information for forming an envelope waveform. Also, the parameter providing section 15 includes a tone volume adjusting section 16 for adjusting the total tone volume of a tone to be generated.

The envelope signal EGL generated from the envelope generating section 14 and a total tone volume adjusting information VOL generated from the tone volume adjusting section 16 are operated together by an operator 17 so that an envelope signal EGL' incorporating the total tone volume adjusting information VOL is obtained. This envelope signal EGL' is given to an operator 18 in which it is operated with a tone signal outputted from the tone forming section 13, so as to control the tone volume envelope of the tone signal. As is well known, if the tone signal, envelope signal and total tone volume adjusting information are expressed in logarithmic values, the operators 17, 18 may be adders; whereas, if they are expressed in linear values, the operator 17, 18 may be multipliers.

The output of the operator 18 is converted to an analog signal by a digital-to-analog converter 19 and is then sent to a sound system 20.

The truncating channel detector unit 10 includes a greatest-attenuation channel detecting section 21 which receives from the operator 17 the envelope signal EGL' incorporating the total tone volume adjusting information VOL, make successive comparisons between the levels of the envelope signals of the individual channels and then detects, on the basis of thus compared level values, a greatest-attenuation channel. The number of the channels that are detectable in the greatest-attenuation channel detecting section 21 is fixed at a specific number N. In the example of FIG. 1, it is assumed that the number M of the channels in the tone forming section 13 is the same as N (or may be smaller than N). Data indicative of the detected greatest-attenuation channel is fed as a truncating channel designating data TCH to the tone generation assigning section 12. The tone generation assigning section 12, when it has received this truncating channel designating data TCH and has been given play information (key code KC) to be newly assigned, assigns this new play information (key code KC) to the channel designated by the truncating channel designating data TCH or to an empty or unoccupied channel if any.

In the greatest-attenuation channel detecting section 21, all of the channels are not caused to be detected or made objects of detection (detection-object channel); instead, detection-object channel designating information EGCH is received from an exclusion condition determining section 23 so that the required greatest-attenuation channel detecting process can be effected only with respect to detection-object channels designated by the designating information EGCH. Such detection-object channel designating operation may be suitably implemented for purposes as noted in a)–c) below.

a) In a case where some of the channels are fixedly or exclusively used for generation of certain tones (tone colors), and hence a greatest-attenuation channel or an empty channel is to be chosen out of the remaining channels for generation assignment of a tone corresponding to a newly depressed key, the operation will function in such manner that the detection-object channels is designated with the fixedly used channels being excluded. If, for example, tones of specific tone colors like those of a drum and other percussion instruments are generated in such fixedly used channels, the detection-object channel designation is implemented with the fixedly used channels being excluded.

b) In a case where the lowest-pitched tone among those being generated is basically, regarded as a bass tone, and it is desired that the channel to which the lowest-pitched tone is being assigned be excluded because the lowest-pitched tone is generally more preferable in the musical sense when given sufficient attenuation and then a greatest-attenuation channel or an empty channel be chosen out of the remaining channels for generation assignment of a tone corresponding to a newly depressed key, the operation will so function as to implement the detection-object channel designation, excluding the channel to which the lowest-pitched tone is being assigned.

c) In a case where desired tone colors are allowed to be optionally assigned to the individual channels, and thereby different tone colors have been in fact assigned, respectively, to plural channel groups, it becomes necessary that a greatest-attenuation channel or an empty channel is chosen, for tone generation of a tone corresponding to new play information, out of a specific channel group to which a tone color corresponding to the new play information has been assigned. For this purpose, the operation will function in such manner that only the channels concerned with the same tone color may be designated as the detection-object channels.

The purposes mentioned in a)–c) above are only exemplary, and the detection-object channel designation may be of course used for other purposes. In accordance with various purposes such as mentioned in a)–c) above and based on the output such as from the tone generation assigning section 12 or from the parameter providing section 15, the exclusion condition determining section 23 determines which channel is to be excluded from the detection-object channel designation and then outputs detection-object channel designating information EGCH that designates the detection-object channels exclusive of the channels determined to be excluded.

The truncating channel detector unit 10 may be provided with an input terminal EXIN for receiving an envelope signal of a greatest-attenuation channel detected by a greatest-attenuation channel detecting section of another truncating channel detector unit. The detector unit 10 may further include an identifying section 22 that compares the level of the envelope signal received through the input terminal EXIN with the level of the envelope signal of the greatest-attenuation channel detected by its greatest-attenuation detecting section 21, so as to identify one greatest-attenuation channel detecting section connected with one greatest-attenuation channel where attenuation has progressed in the farthest degree. Nevertheless, in a case where only one truncating channel detector unit 10 is used as in the system of FIG. 1, the identifying section 22 does not practically function. In such case, since no other envelope signal is received at the input terminal EXIN, the channel detected by its own greatest-attenuation channel detecting section 21 will be considered to be the channel where attenuation has progressed in the farthest degree.

Figure 2:
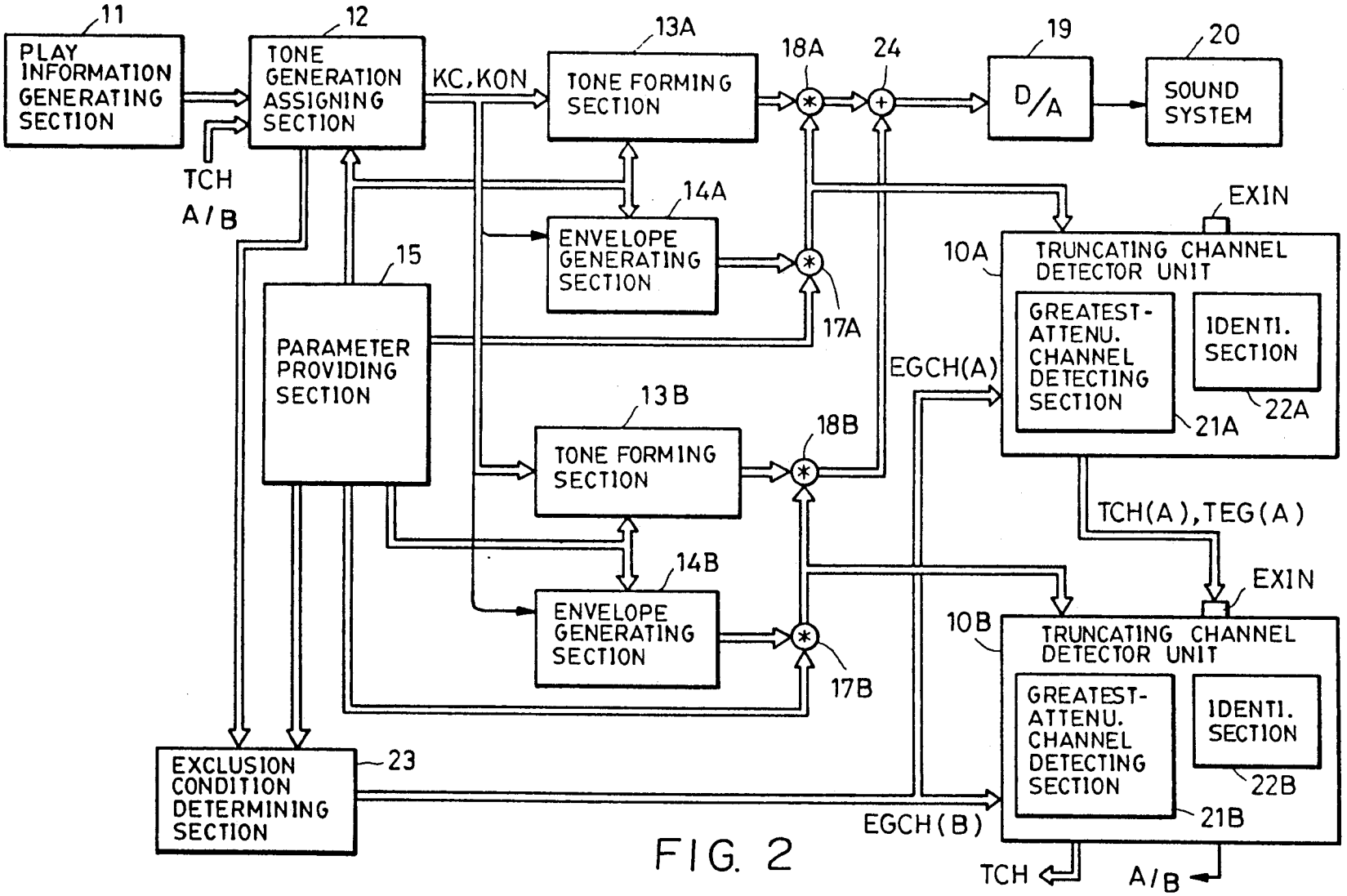
FIG. 2 is a block diagram showing another example systematic arrangement of an electronic musical instrument embodying the present invention.

FIG. 2 shows another example systematic arrangement of an electronic musical instrument that embodies the present invention and particularly illustrates an expanded version in which two truncating channel detector units 10A, 10B are provided.

In this example, two tone forming sections 13A, 13B each having N channels are provided to expand the total number of tone forming channels. There are also provided two groups of envelope generating sections 14A, 14B, and operators 17A, 17B, 18A, 18B in correspondence to the tone forming sections 13A, 13B, so that output signals from the operator 18A, 18B may be added together by an adder 24 and then fed to a digital-to-analog converter 19. It goes without saying that a tone generation assigning section 12 is so constructed as to enable tone generation assignment process required for the expanded number of the channels. Correspondingly, an exclusion condition determining section 23 is so constructed as to output detection-object channel designating information EGCH(A), EGCH(B) for each of the groups.

Each of the truncating channel detector unit 10A, 10B may be identical in construction with the truncating channel detector unit 10 shown in FIG. 1 and each of them includes a greatest-attenuation channel detecting section 21A, 21B that is capable of detecting a greatest-attenuation channel out of N channels. To the greatest-attenuation channel detecting section 21A of the truncating channel detector unit 10A of A group, are given an envelope signal outputted from the operator 17A and detection-object channel designating information EGCH(A). Likewise, to the greatest-attenuation channel detecting section 21B of the truncating channel detector unit 10B of B group, are givn an envelope signal outputted from the operator 10B and detection-object channel designating information EGCH(B).

Data TCH(A) indicative of the greatest-attenuation channel detected by the greatest-attenuation channel detecting section 21A of the A group truncating channel detector unit 10A, and an envelope signal TEG(A) of the detected channel are fed to an input terminal EXIN of the B group truncating channel detector unit 10B. Then, an identifying section 22B of the B group truncating channel detector unit 10B makes a comparison between the envelope signal detected by the A group greatest-attenuation channel detecting section 21A and fed to the input terminal EXIN, and the envelope signal detected by its own greatest-attenuation channel detecting section 21B, and thereby identifies one detecting section 21A or 21B connected with a channel in which attenuation has progressed in the farthest degree among all the channels. Data A/B indicative of thus identified one detecting section 21A or 21B, and data TCH indicative of the greatest-attenuation channel detected by the identified one detecting section 21A or 21B are given to the tone generation assigning section 12. In the tone generation assigning section 12, a single channel identified by both the data A/B and TCH is designated as a truncating channel for subsequent tone generation assignment process as mentioned above.

It is now assumed for example that $N=4$, the total number M of the tone generation channels in the tone forming section 13A, 13B is $4+4=8$, and the A group takes charge of the first to forth channels while the B group takes charge of the fifth to eighth channels. In this case, if it is further assumed that the A group greatest-attenuation channel detecting section 21 has detected the third channel of the $N=4$ channels as the greatest-attenuation channel while the B group greatest-attenuation channel has detected the second channel of the $N=4$ channels as the greatest-attenuation channel, and also that the greatest-attenuation channel of the B group has showed farther attenuation than the counterpart of the A group, then data A/B will indicate the B group, and data TCH will indicate the second channel. Thus, the second channel of the B group, that is, the sixth channel will be designated as a truncating channel.

It will be readily understood that the identifying section 22A in the A group truncating channel detector unit 10A is not essential or necessary. Nevertheless, the unnecessary identifying section 22A is shown here because of standardization of the hardware circuitry of the truncating channel detector unit.

Now, the detail of the truncating channel detector unit 10 will be described with reference to FIG. 3. In this example, it is also assumed that N=4.

First of all, the greatest-attenuation channel detecting channel 21 will be described on the assumption that the envelope signal EGL' supplied from the operator 17 is data indicative of attenuation volume, and that a larger value of the data represents a larger attenuation volume, namely, a smaller tone volume. Accordingly, this greatest-attenuation channel detecting section 21 detects a channel of which data value of the envelope signal EGL' is the greatest among four specific channels and thereby detects the channel as the greatest-attenuation channel.

Figure 4:
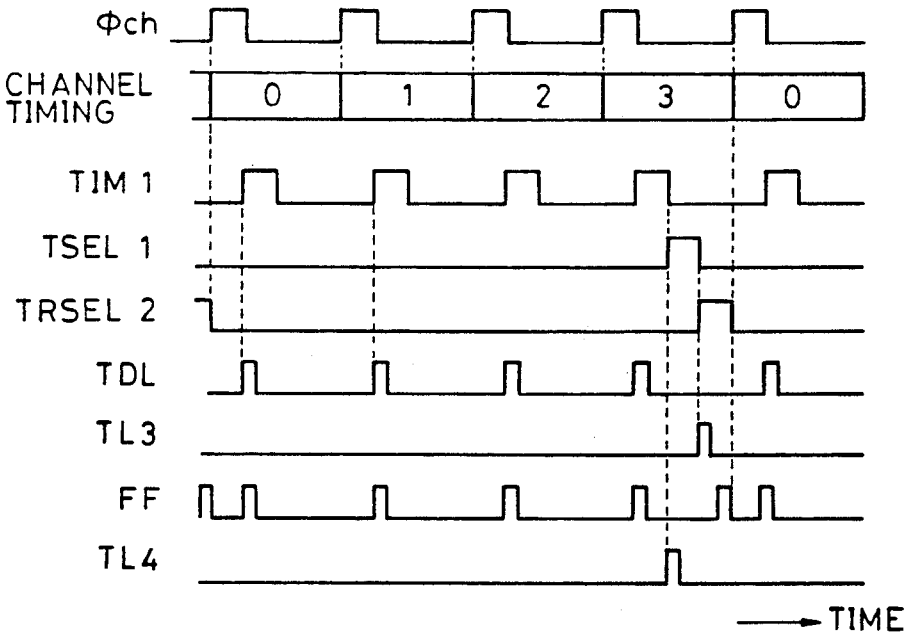
FIG. 4 is a chart of showing the timings of various signals shown in FIG. 3.

In this example, it is also assumed that the envelope signal EGL' of each channel supplied from the operator 17 is time-divisionally multiplexed at the channel timing as shown in FIG. 4. This envelope signal EGL' is given the to "0" input of a selector 30. To the "1" input of the selector 30, the envelope signal of the greatest-attenuation channel detected by the other greatest-attenuation channel detecting section is fed through the input terminal EXIN. A selection control signal TSEL1 applied to the selector 30 is such a signal as shown in FIG. 4, which normally selects the envelope signal EGL' of the "0" input but, in the latter half of the last channel time slot, selects the envelope signal fed through the input terminal EXIN.

The output of the selector 30 is supplied to A input of a comparator 31. To B input of the comparator 31, the output of a latch 32 is fed. As a result of comparison in the comparator 31, the larger date (data indicating farther attenuation) is latched into the latch 32. Namely, the output of the latch 32 is fed back to its input via the "0" input, and the envelope signal EGL' from the operator 17 is supplied to the "1" input of the selector 33. Next, if A<B as a result of comparison by the comparator 31, then the "0" input of the selector 33 is selected so that the stored data in the latch 32 is maintained; however, if A≧B, then "1" is outputted from "A≧B" output of the comparator 31 so that a signal for selecting the "1" input is given to the control input of the selector 33, and the envelope signal EGL' from the operator 17 is selected to be latched into the latch 32.

A channel counter 35 which counts clock pulses as shown in FIG. 4 at modulo 4 outputs data indicative of the individual channels 0–3 in accordance with the respective timings of the channels 0–3. The output of the channel counter 35 is latched into a latch 36 in accordance with an output signal "1" of an AND gate 34.

The output of the selector 33 is, as shown in FIG. 4, cleared by a signal TRSEL 2 that becomes "1" at the end of the timing of the channel 3. Consequently, all "0" is latched into the latch 32 at the timing of the first channel 0. It is to be noted that a latch timing signal TDL to the latch 32 is generated at each channel timing, as shown in FIG. 4. At the first channel 0, A≧B is met in the comparator 31, and therefore the level value data of the envelope signal EGL' of the channel 0 is latched into the latch 32. Next, the data latched in the latch 32 and the level value data of the envelope signal EGL' of the channel 1 are compared with each other, so that the larger value of the two is latched into the latch 32. In this manner, the envelope signals EGL' of the four channels 0–3 are successively compared, and the value data which has been finally turned out to be the largest of all is latched into the latch 32. On the other hand, each time new level data of the envelope signal EGL' is latched into the latch 32 in accordance with the output "1" of the AND gate 34, data indicative of the channel associated with the envelope signal EGL' is latched into the latch 36. Thus, data indicative of the channel of the largest envelope signal value (the channel showing the farthest degree of attenuation) is finally latched into the latch 36. Subsequently, the output of the latch 36 is provided to a latch 37 and then taken into the latch 37 by a signal which becomes "1" at the end of the timing of the last channel 3 as shown in FIG. 4.

The detection-object channel designating information EGCH, which is composed of parallel four bits corresponding to of the four channels, respectively, is temporarily taken into a latch 38, from where it is sent to a parallel-to-serial converter 39 to be converted to serial data and is made time-divisional data that corresponds to the timings of the respective channels. This detection-object channel designating information EGCH will be signal "1" for the channels that are made the objects of the greatest-attenuation channel detection and will be signal "0" for the channels that are excluded from or made non-objects of the greatest-attenuation channel detection. The detection-object channel designating information EGCH is fed to an AND gate 40 where it is ANDed with the key-on signals of the individual channels. In this case, the key-on signal KON is a time-divisional signal indicating that the individual associated channel is in the midst of tone generation or tone generation assignment and is used for detecting the greatest-attenuation channel out of such channels in the midst of tone generation or tone generation assignment.

The output of the AND gate 40 is applied to the AND gate 34. The A≧B output signal of the comparator 31, the inverted signal of an attack segment signal SEGA as well as a timing signal TIM1 are also applied to the AND gate 34. The attack segment signal SEGA, which is time-divisionally given from the envelope generating means 14 in correspondence to the individual channels, will be "1" if the envelope signal of the channel concerned corresponds to the attack segment of the rising tone and will be "0" if the envelope signal of the channel concerned corresponds to the other segments of the tone. Thus, the inverted signal of the attack segment signal SEGA will be "0" if the envelope signal of the channel concerned corresponds to the attack segment of the rising time, thereby, making the AND gate 34 inactive. Consequently, a small level portion at the attack segment of the envelope signal can be prevented from being erroneously detected as the greatest-attenuation channel. The timing signal TIM1 is generated in such a manner as shown in FIG. 4, so as to provide a timing at which the comparison output signal is given as a selection control signal to the selector 33.

The output of the AND gate 34 is inverted by an inverter 41 and is then given to a flip-flop 44 via an AND gate 42 and an OR gate 43. The flip-flop 44 is controlled by such a timing signal FF as shown in FIG. 4 and its output is fed back to the AND gate 42. The abovementioned signal TRSEL2 is given to the other input of the OR gate 43 so that the contents of the flip-flop 44 is set to "1" at the begining of the timing of the first channel 0. Next, once the output of the AND gate 34 has become "I" at the timing of any of the channels 0-3, the AND gate 42 becomes inactive, and the contents of the flip-flop 44 is reset to "0". When all the channels are in the midst of attack or not the detection-object channels, the output of the AND gate 34 does not become "1" so that the contents of the flip-flop 44 remains set at "1", and this output of the flip-flop 44 is used as an invalid signal INVAL. When the invalid signal INVAL is "1", it is meant that all of the four channels are unusable or unavailable. Into the abovementioned latch 37, is this invalid signal INVAL latched together with the data indicative of the greatest-attenuation channel. The invalid signal INVAL indicates an effective value at the latch timing of the latch 37 (at the timing of the signal TL3).

If only one truncating channel detector unit 10 is provided as shown in FIG. 1, the data indicative of the greatest-attenuation channel latched in the latch 37 is given as the truncating channel designating data TCH to the tone assigning means 12 together with the invalid signal INVAL.

If two truncating channel detecting units 10A, 10B are provided, the data indicative of the greatest-attenuation channel latched in the latch 36 in one of the truncating channel detector unit 10A and the invalid signal INVAL are sent out via a gate 45, so that they are inputted to the input terminal EXIN of the other truncating channel detector unit 10B as the A group's greatest-attenuation channel detection data TCH(A) and invalid signal INVAL(A), respectively. Additionally, the level data of the envelope signal of the greatest-attenuation channel latched in the latch 32 is sent out via the gate 45 and is inputted to the input terminal EXIN of the other truncating channel detector unit 10B as envelope signal level data TEG(A) of the greatest-attenuation channel of the A group. The gate 45 is opened at the timing of the signal TSEL.

Figure 3:
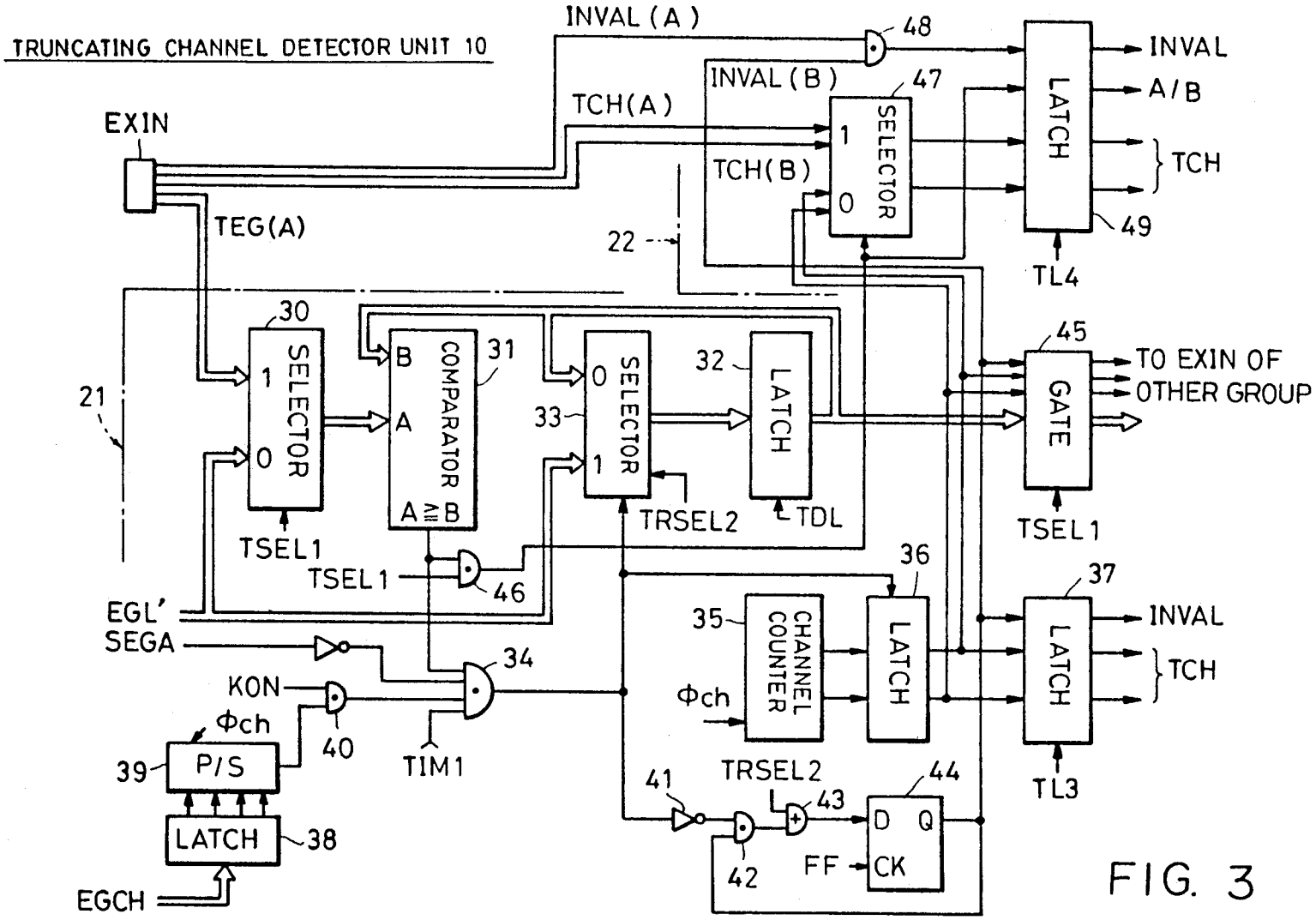
FIG. 3 is a block diagram showing the detail of a truncating channel detector unit shown in FIGS. 1 and 2.

Next, the identifying means 22 will be described, assuming that the truncating channel detector unit 10 of FIG. 3 is the truncating channel detector unit 10B of the B group. The envelope signal level data TEG(A) of the A group greatest-attenuation channel inputted to the input terminal EXIN of the truncating channel detector unit 10B is given to the "1" input of the selector 30 where it is selected at the timing of the signal TSEL1, and is then provided to the A input of the comparator 31. By this time, the greatest-attenuation channel detecting means 21B of the B group has already completed its own greatest-attenuation channel detection process, and the level data of the envelope signal of the detected greatest-attenuation channel has been latched in the latch 32. Then, the comparator 31, at the timing of the signal TSEL1 (namely, at the timing of the latter half time slot of the last channel 3), makes a comparison between the level of the envelope signal TEG(A) of the A group greatest-attenuation channel and the level of the envelope signal TEG of the B group greatest-attenuation channel, and produce "1" from the $A \geqq B$ output if the level of the envelope signal TEG(A) of the A group is larger of the two, so that "1" is given to the AND gate 46. The AND gate 46 is enabled at the timing of the signal TSEL1 and supplies its output to a control input of a selector 47 provided within the identifying means 22. (At the timing of "1" of the signal TSEL1, the timing TIM1 is "0" and the AND gates 34 is inactive.)

In the identifying means 22, data TCH(B) of the greatest-attenuation channel detected by the associated greatest-attenuation channel detecting means 21 is given from the latch 36 to "0" input of the selector 47. An invalid signal INVAL(B) for the B group is inputted to an AND gate 48. Further, the data TCH(A) indicative of the A group greatest-attenuation channel inputted to the input terminal EXIN is given to "1" input of the selector 47, and an invalid signal INVAL(A) of the A group is inputted to the other input of the AND gate 48.

Accordingly, when the envelope signal of the A group greatest-attenuation channel is larger in level, namely, shows farther attenuation, the output of the AND gate 46 is "1", so that the data TCH(A) indicative of the A group greatest-attenuation channel and given to the "1" input of the selector 47 is selected to be latched into a latch 49. Conversely, when the envelope signal of the B group greatest-attenuation channel is larger in level, namely, shows farther attenuation, the output of the AND gate 46 is "0", so that the data TCH(B) indicative of the B group greatest-attenuation channel and given to the "0" input of the selector 47 is selected to be inputted to the latch 49.

Further, when both of the A and B groups are unavailable, the invalid signals INVAL(A), INVAL(B) of the groups are both "1" so that "1" is outputted from the AND gate 48. However, when at least either one of the groups is available, "0" is outputted from the And gate 48. This output of the AND gate 48 is fed to the latch 49 as a total invalid signal INVAL. Also, the output signal of the AND gate 46 is located into the latch 49 as a signal A/B that identifies one of the A and B groups.

The latch controlling input signal TL4 becomes "1" in accordance with the timing of the signal TSEL1 as shown in FIG. 4, so as to latch each of the abovementioned data fed to the latch 49. The data indicative of the greatest-attenuation channel of the A or B group and the group identifying signal A/B as well as the invalid signal INVAL are given to the tone generation assigning means 12.

So far, the example where two truncating channel detector units 10 are provided has been described, but it is of course possible to provide more truncating channel detector units 10, in which case minor design modifications, such as suitably modifying the number of bits for the group identifying signal A/B, may be made as required. Also, electrical connection with respective input terminals EXIN may be made by connecting the units in cascade fashion, in which case the output of the latch 49 of the last unit is given to the tone generation section 12.

Further, although the example where one greatest-attenuation channel detecting means detects the greatest-attenuation channel out of the specific number $N=4$ of channels has been described, N is not necessarily limited to 4.

The envelope signal value need not be expressed in the form of attenuation as described above but may be in the form of ordinary data; in the latter case, the smallest value of the data will be detected.

Moreover, the present invention can be used for other purposes than the truncating process. For example, the invention can be applied to a case where the greatest-volume (smallest-attenuation) channel is to be detected. Also, the application of the invention is not restricted to the detection of an extreme value (namely, the greatest or smallest value) of an envelope signal controlling a tone volume, but can be extended to such an extreme value detection of an envelope signal which controls other tone elements.

As set forth above, according to the present invention, one or more detecting units is provided for detecting an extreme value (i.e., the greatest or smallest value) of envelope signal levels related to a specific number of channels, and the extreme values detected by the respective detecting units are compared with each other so that one detecting unit connected with the greatest or smallest extreme value is identified. With this arrangement, there can be achieved superior advantageous results that it is possible to properly deal with the expansion of channels by providing a specific number of the detecting units as required in correspondence to the number of channels in a tone forming section.

What is claimed is:

1. An electronic musical instrument comprising:

tone forming means capable of forming tone signals in plural number M of channels;

envelope generating means for generating for each of said channels an envelope signal to control said tone signal; and a plurality of extreme-value channel detector units, each of said detector units having detecting means that receives the envelope signals related to a predetermined number N of the channels to detect a channel showing a greatest or smallest level of the envelope signal among said N channels and outputs data indicative of a detected channel and of the envelope signal level of the detected channel, M being larger than N; an external data input terminal for receiving channel data indicative of a channel detected by other detector unit and level data indicative of a level of an envelope signal of the detected channel; and controlling means for making a comparison between the level of the envelope signal received through said external data input terminal and the level of the envelope signal detected by said detecting means so as to select a channel of a larger or smaller level of the compared levels and detecting as said extreme-value channel the channel showing the larger or smaller level, said number M of the channels being shared among said detecting means of the detector units so that the channel of which level of the envelope signal is greatest or smallest is detected in each of said detector units.

2. An electronic musical instrument comprising:

tone forming means capable of forming tone signals in plural number M of channels;

envelope generating means for generating for each of said channels an envelope signal to control said tone signal;

a plurality of extreme-value channel detector units, each of said detector units having detecting means that receives the envelope signals related to a predetermined number N of the channels to detect a channel showing a greatest or smallest level of the envelope signal among said N channels and outputs data indicative of a detected channel and of the envelope signal level of the detected channel, M being larger than N, and controlling means for making a comparison between the data of the envelope signal levels outputted by said detecting means so as to select as said extreme-value channel a channel further showing the largest or smallest level; and excluding means for excluding from all the channels one or more channels conforming to a predetermined condition so that the extreme-value channel detecting units are caused to detect the extreme-value channel from among the remaining channels.

3. An electronic musical instrument as defined in claim 2 wherein said excluding means excludes a channel to which generation of a tone of a predetermined tone color is assigned.

4. An electronic musical instrument as defined in claim 2 wherein said excluding means excludes a channel to which a lowest-pitched tone among all tones assigned to the respective channels is being assigned.

5. A method of designating an extreme-value channel in an electronic musical instrument which has tone forming means capable of forming tone signals in a plural number M of channels, and envelope generating means for generating for each of the channels an envelope signal to control the tone signal, said method designating as the extreme-value channel a channel showing a greatest or smallest level of the envelope signal among said channels, said method comprising the steps of:

dividing the envelope signals of said M channels into a plurality of groups, each group consisting of not more than N envelope signals;

comparing the level of the envelope signals within each group to determine which one of said N envelope signals in each group has the greatest or smallest envelope signal level, and identifying the channel associated with the greatest or smallest envelope signals from each group; and comparing the level of the envelope signals from the identified channels to select the one identified channel having the envelope signal with the greatest or smallest envelope signal level, and designating the one selected channel as the extreme-value channel.

6. A method as defined in claim 5, wherein said envelope signals control volume amplitude levels of tones and said comparisons determine which of the envelope signals has the smallest envelope signal level.

* * * * *